US006637040B1

(12) United States Patent
Alba

(10) Patent No.: US 6,637,040 B1
(45) Date of Patent: Oct. 28, 2003

(54) VENTILATED COMMODE DEVICE, KIT AND METHOD OF USING

(76) Inventor: Uleses Alba, 521 N. 220 W., Laverkin, UT (US) 84745

( * ) Notice: Subject to any disclaimer, the term of this patent is extended or adjusted under 35 U.S.C. 154(b) by 0 days.

(21) Appl. No.: 10/234,943

(22) Filed: Sep. 4, 2002

(51) Int. Cl.[7] ..... E03D 9/04
(52) U.S. Cl. ..... 4/217; 4/240
(58) Field of Search ..... 4/217, 213, 240, 4/237

(56) References Cited

U.S. PATENT DOCUMENTS 3,790,970 A * 2/1974 Bendersky et al. ..... 4/217
3,916,459 A * 11/1975 Ivancevic ..... 4/217 X
4,125,906 A * 11/1978 Weiland ..... 4/217
6,016,576 A * 1/2000 Happe ..... 4/217 X
6,526,598 B1 * 3/2003 Black ..... 4/217 X

* cited by examiner

*Primary Examiner*—Gregory L. Huson
*Assistant Examiner*—Kathleen J. Prunner

(57) ABSTRACT

A new and improved ventilated commode device, kit and method of using is disclosed for using the device in removing odorous vapors from the immediate vicinity of the device into a sewer line. The ventilated commode device comprises a seat having a plurality of input vent holes fluidly communicating to an internal air passageway and terminating with an output vent hole positioned at the rear portion of the seat. The device also comprises a hinge having an air pathway fluidly connected to the output vent hole of the seat and fluidly connected to a hollow chamber in a toilet bowl. The hollow chamber comprises an air pump which actively moves the captured odorous vapors from the hollow chamber into the rear portion of the waste water drainage network of the toilet. The kit comprises the device and an annular gasket. The method of using the kit comprises the steps of activating, connecting, defecating, flushing, mounting, obtaining, placing, and plumbing.

20 Claims, 4 Drawing Sheets

VENTILATED COMMODE DEVICE, KIT AND METHOD OF USING

FIELD OF THE INVENTION

The present invention relates to commodes, more particularly, to a ventilated commode device capable of actively removing a portion of the odorous vapors around the immediate vicinity of the toilet seat by actively pumping the vapors directly into the sewer line.

DESCRIPTION IF THE PRIOR ART

It is desirable from an aesthetic standpoint to remove, eliminate or neutralize odors produced when a toilet is in use, and heretofore a number of attempts have been made to provide vented toilets. It is well known in the prior art to provide a fame assembly that produces a suction to draw away odorous air from the toilet bowl when the toilet is in use, so that the odorous air may be passed through a conduit and exhausted from the building. A wide variety of vented toilets is currently available on the commercial market and an even larger number of these types of devices are known in the art of vented toilets, for example, the toilet ventilating apparatus disclosed by Weiland in U.S. Pat. No. 4,125,906; the ventilated toilet disclosed by Wadsworth in U.S. Pat. No. 4,617,687; the toilet ventilating manifold system disclosed by Hilton in U.S. Pat. No. 5,386,594; the toilet ventilation system disclosed by Johnson in U.S. Pat. No. 5,724,682; the toilet ventilation system disclosed by Hugo Ceja Estrada in U.S. Pat. No. 5,727,263; the commode odor extractor disclosed by Boykin in U.S. Pat. No. 5,590,423; the ventilated toilet seat system disclosed by Guzzo and Guzzo in U.S. Pat. No. 6,237,163; and the toilet ventilator disclosed by Galasso and Gallasso in U.S. Pat. No. D355,960.

While all of the above-described devices fulfill their respective, particular objectives and requirements, the aforementioned patents do not describe a ventilated commode device having an air pump fluidly connected to the immediate vicinity of the toilet seat and fluidly connected to the sewer line. These features would specifically match the user's particular individual needs of making it possible to actively remove a portion of the odorous vapors around the immediate vicinity of the toilet seat by actively pumping the vapors directly into the sewer line. The above-described patents make no provision for a ventilated commode device having an air pump fluidly connected to the immediate vicinity of the toilet seat and fluidly connected to the sewer line.

Therefore, a need exists for a new and improved ventilated commode device that can be used for actively removing a portion of the odorous vapors around the immediate vicinity of the toilet seat by actively pumping the vapors directly into the sewer line. In this respect, the ventilated commode device according to the present invention substantially departs from the conventional concepts and designs of the prior art, and in doing so provides an apparatus primarily developed for the purpose of providing a ventilated commode device having an air pump fluidly connected to the immediate vicinity of the toilet seat and fluidly connected to the sewer line.

SUMMARY OF THE INVENTION

The present device, kit and method according to the principles of the present invention, overcomes the shortcomings of the prior art by providing a new and improved ventilated commode device, kit and method of using for using the device in removing odorous vapors from the immediate vicinity of the device into a sewer line. The ventilated commode device comprises a seat having a plurality of input vent holes fluidly communicating to an internal air passageway and terminating with an output vent hole positioned at the rear portion of the seat. The device also comprises a hinge having an air pathway fluidly connected to the output vent hole of the seat and fluidly connected to a hollow chamber in a toilet bowl. The hollow chamber comprises an air pump which actively moves the captured odorous vapors from the hollow chamber into the rear portion of the waste water drainage network of the toilet. The kit comprises the device and an annular gasket. The method of using the kit comprises the steps of activating, connecting, defecating, flushing, mounting, obtaining, placing, and plumbing.

In view of the foregoing disadvantages inherent in the known type vented toilets now present in the prior art, the present invention provides an improved ventilated commode device, which will be described subsequently in great detail, is to provide a new and improved ventilated commode device which is not anticipated, rendered obvious, suggested, or even implied by the prior art, either alone or in any combination thereof.

To attain this, the present device invention essentially comprises a seat having a plurality of input vent holes fluidly communicating to an internal air passageway and terminating with an output vent hole positioned at the rear portion of the seat. The device also comprises a hinge having an air pathway fluidly connected to the output vent hole of the seat and fluidly connected to a hollow chamber in a toilet bowl. The hollow chamber comprises an air pump which actively moves the captured odorous vapors from the hollow chamber into the rear portion of the waste water drainage network of the toilet.

There has thus been outlined, rather broadly, the more important features of the invention in order that the detailed description thereof that follows may be better understood, and in order that the present contribution of the art may be better appreciated.

The invention may also include and optional seat cover pivotally attached to the hinge of the ventilated commode device. There are of course, additional features of the invention that will be described hereinafter and which will form the subject matter of the claims attached.

Numerous objects, features and advantages of the present invention will be readily apparent to those of ordinary skill in the art upon reading of the following detailed description of presently preferred, but nonetheless illustrative, embodiments of the present invention when taken in conjunction with the accompany drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved ventilated commode device that has all the advantages of the prior art ventilated commode device and none of the disadvantages.

It is another object of the present invention to provide a new and improved ventilated commode device that may be easily and efficiently manufactured and marketed.

An even further object of the present invention is to provide a new and improved ventilated commode device that has a low cost of manufacture with regard to both materials and labor, and which accordingly is then susceptible of low prices of sale to the consuming public, thereby making such multipurpose storage unit and system economically available to the buying public.

Still another object of the present invention is to provide a new ventilated commode device that provides in the apparatuses and methods of the prior art some of the advantages thererof, while simultaneously overcoming some of the disadvantages normally associated therewith.

Even still another object of the present invention is to provide a ventilated commode device having an air pump fluidly connected to the immediate vicinity of the toilet seat and fluidly connected to the sewer line. This makes it possible to actively remove a portion of the odorous vapors around the immediate vicinity of the toilet seat by actively pumping the vapors directly into the sewer line.

Yet, it is another object of the present invention to provide a new and improved kit for installing the ventilated commode device comprising the ventilated commode device and an annular gasket.

Lastly, it is an object of the present invention to provide a new and improved method of using the kit comprises the steps of activating, connecting, defecating, flushing, mounting, obtaining, placing, and plumbing.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompany drawings and description matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DETAILED DESCRIPTION OF THE PREFERRED EMBODIMENT

Figure 1:
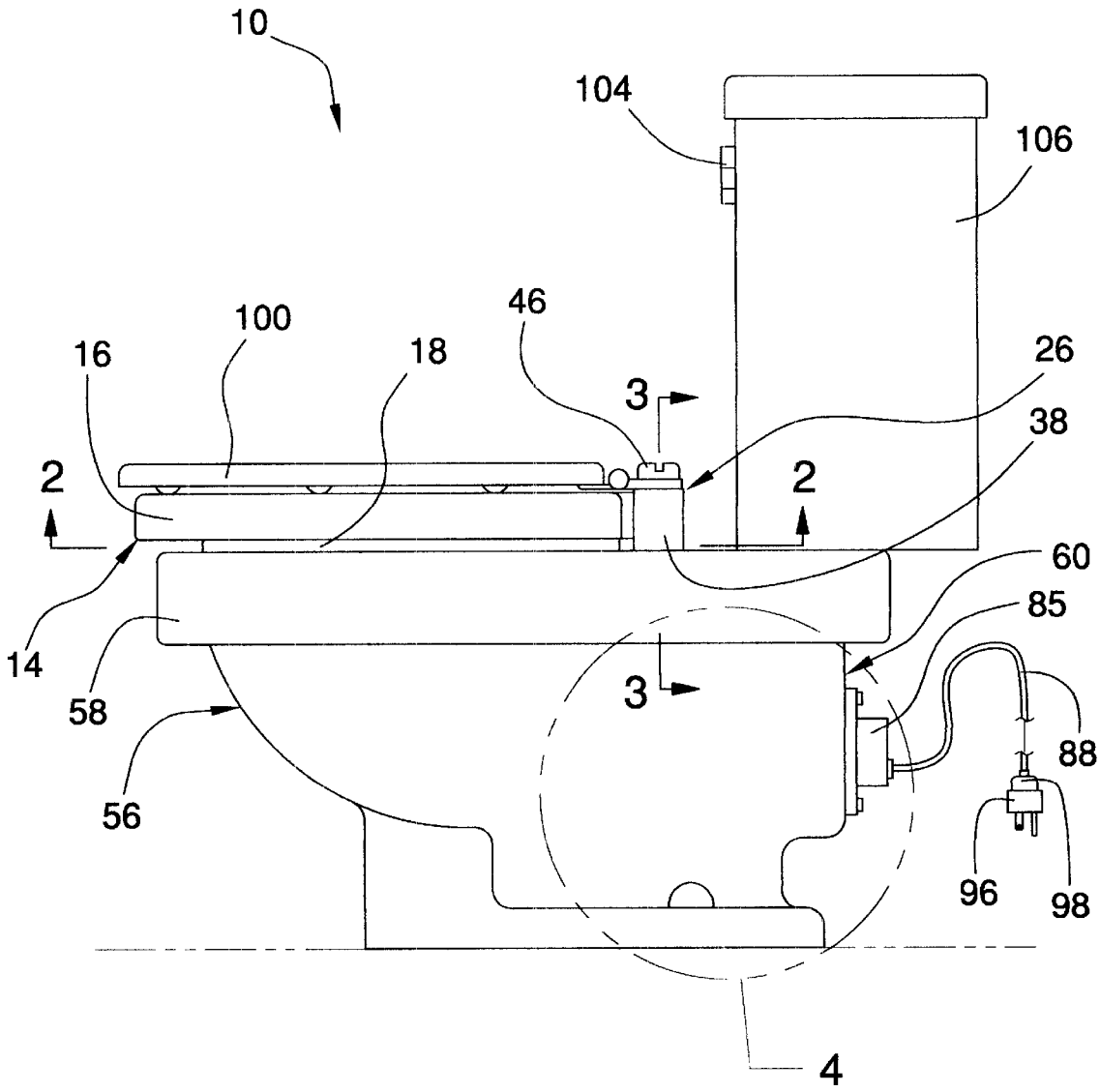
FIG. 1 is a side view of a preferred embodiment of the ventilated commode device constructed in accordance with the principles of the present invention.

Referring now to the drawings, and in particular FIG. 1 to 4 thereof, one preferred embodiment of the present invention is shown and generally designated by the reference numeral 10. One preferred embodiment of the ventilated commode device 10 for removing odorous vapors from the immediate vicinity of the device 10 into a sewer line 12, the device 10 comprising: a seat 14 including: a rounded perimeter 16 defining a hollow center, the perimeter 16 for receiving a portion of a user's buttocks; a footer gasket 18 attached around a portion of the bottom of the seat 14; a plurality of input vent holes 20 positioned along the seat 14 between the footer gasket 18 and the inside edge of the perimeter 16; a output vent hole 22 positioned at the rear portion of the seat 14; and an internal air passageway 24 formed within the seat 14, the air passageway 24 is in fluid communications with the plurality of input vent holes 20 and with the output vent hole 22; a hinge 26 connected to the seat 14, the hinge 26 including: a cross bar 28 having: at least one flange 30 connected to the seat 14; an intake orifice 32 in fluid communications with the output vent hole 22 of the seat 14; an internal airway 34 within the cross bar 28, the internal airway 34 in fluid communication with the intake orifice 32 of the cross bar 28; and an output orifice 36 in at least one end of the cross bar 28, the output orifice 36 in the one end of the cross bar 28 in fluid communications with the internal airway 34 of the cross bar 28; a pair of mounting shafts 38, each mounting shaft 38 having: a concave collar 40 on the side of each respective mounting shaft 38, wherein the concave collar 40 of each respective mounting shaft 38 is rotatably attached to a corresponding end of the cross bar 28; and a hollow core 42 in each respective mounting shaft 38, at least one mounting shaft 38 having an intake hole 44 within the concave collar 40 of the mounting shaft 38 having the intake hole 44, the intake hole 44 of the mounting shaft 38 having the intake hole 44 in fluid communications with the hollow core 42 of the mounting shaft 38 having the intake hole 44; the intake hole 44 of the mounting shaft 38 having the intake hole 44 in fluid communications with the corresponding output orifice 36 in the one end of the cross bar 28; a pair of mounting bolts 46, each mounting bolt 46 having a threaded distal end 48, each respective mounting bolt 46 is attached into the hollow core 42 of each corresponding mounting shaft 38, at least one mounting bolt 46 having a hollow cavity 50, the mounting bolt 46 having the hollow cavity 50 having an intake port 52 and an exit port 54, the intake and exit ports (52 and 54) of the mounting bolt 46 having the hollow cavity 50 in fluid communications with the hollow cavity 50 of the mounting bolt 46 having the hollow cavity 50, the intake port 52 of the mounting bolt 46 having the hollow cavity 50 in fluid communications with the intake hole 44 of the mounting shaft 38 having the intake hole 44; a toilet bowl 56 having a mouth 58 and a back 60, the toilet bowl 56 including: a waste water drainage network 62 in fluid communications with the sewer line 12; a pair of bolt holes 64, each respective bolt hole 64 having a corresponding threaded nut 66 imbedded within the toilet bowl 56 near the distal end of each respective bolt hole 64, each threaded nut 66 of each respective bolt hole 64 is screw fitted to the threaded distal end 48 of each corresponding mounting bolt 46 of the hinge 26, at least one bolt hole 64 having an open input portal 68 at the distal end of the bolt hole 64 having the open input portal 68, the open input portal 68 of the bolt hole 64 having the open input portal 68 in fluid communications with the exit port 54 of the mounting bolt 46 having the hollow cavity 50; a hollow chamber 70 fluidly connected to the open input portal 68 of the at least bolt hole 64 having the open input portal 68, the hollow chamber 70 having: an air intake tube 72 having an input end 76 and an output end 78, the input end 76 of the air intake tube 72 is attached to the open input portal 68 of the bolt hole 64 having the open input portal 68, the air intake tube 72 in fluid communications with the open input portal 68 of the bolt hole 64 having the open input portal 68; an outlet portal 78 of the hollow chamber 70 in fluid communications with the bottom portion of the waste water drainage network 62; an air pump 80 attached to the toilet bowl 56, the air pump 80 having an inlet port 82 and an outlet port 84, the inlet port 82 of the air pump 80 attached to the output end 78 of the air intake tube 72, the air pump 80 in fluid communications with the air intake tube 72; a transformer 86 attached to the air pump 80, the transformer 86 electrically connected to the air pump 80; an electrical cable 88 attached the proximate end of the electrical cable 88 to the transformer 86, the electrical cable 88 is electrically connected to the transformer 86, the distal end of the electrical cable 88 is electrically connectable to a power source; and an air discharge tube 90 having a first end 92 and a second end 94, the first end 92 of the air discharge tube 90 attached to the outlet port 84 of the air pump 80, the air discharge tube 90 in fluid communications with the air pump 80, the second end 94 of the air discharge tube 90 is attached to the outlet portal 78 of the hollow chamber 70, the air discharge tube 90 in fluid communications with the sewer line 12, thereby the a plurality of input vent holes 20 in the seat 14 are in fluid communications with the sewer line 12.

The seat 14 is pivotally attached to the toilet bowl 56 in which when the seat 14 is pivoted downwards onto the mouth 58 of the toilet bowl 56 so that the footer gasket 18 contacts the mouth 58 of the toilet bowl 56, then the seat 14 is in a sitting position. When the seat 14 is pivoted upwards toward the back 60 of the toilet bowl 56 so that the footer gasket 18 does not contact the mouth 58 of the toilet bowl 56, then the seat 14 is in an upright position.

The air pump 80 may further comprise a pair of brackets 108 attached to the toilet bowl 56 along the edge of the hollow chamber 70 of the toilet bowl 56. Furthermore, the air pump 80 may further comprise a pair of mounting pegs 110 attaching the brackets 108 of the air pump 80 to the toilet bowl 56.

The hinge 26 may be attached to the seat 14 by any commercially available means. One preferred means for attaching the hinge 26 to the seat is that it comprises a plurality of screws 112 attaching the flange 30 of the hinge 26 to the seat 14.

The wastewater drainage network 62 of the toilet bowl 56 may be any commercially available wastewater drainage network in a standard toilet bowl 56. One preferred configuration of the wastewater drainage network 62 is that it has a water reservoir 106. Another preferred configuration of the wastewater drainage network 62 of the toilet bowl 56 is that it has a flush switch 104.

An optional electrical plug 96 may be added to the device 10. The electrical plug 96 is attached to the electrical cable 88, in which the electrical plug 96 is electrically connected to the electrical cable 88, the electrical plug 96 is electrically connectable to a standard electrical wall outlet.

An optional ON/OFF switch may be added to the device 10. The ON/OFF switch 98 is attached to the electrical plug 96, in which the ON/OFF switch 98 is electrically connected to the electrical plug 96.

An optional seat cover 100 may be added to the device 10. The seat cover 100 is pivotally attach to the hinge 26 and pivotally attached to the toilet bowl 56.

An optional annular gasket 102 may be added to the device. The annular gasket 102 is connected between said wastewater drainage network 62 of said toilet bowl 56 and the sewer line 12. One preferred configuration of the annular gasket 102 is that it is made of beeswax.

One preferred configuration of the kit for a ventilated commode device 10 for removing odorous vapors from the immediate vicinity of the device 10 into a sewer line 12, the kit comprising: the device 10 comprising: a seat 14 including: a rounded perimeter 16 defining a hollow center, the perimeter 16 for receiving a portion of a user's buttocks; a footer gasket 18 attached around a portion of the bottom of the seat 14; a plurality of input vent holes 20 positioned along the seat 14 between the footer gasket 18 and the inside edge of the perimeter 16; a output vent hole 22 positioned at the rear portion of the seat 14; and an internal air passageway 24 formed within the seat 14, the air passageway 24 is in fluid communications with the plurality of input vent holes 20 and with the output vent hole 22; a hinge 26 connected to the seat 14, the hinge 26 including: a cross bar 28 having: at least one flange 30 connected to the seat 14; an intake orifice 32 in fluid communications with the output vent hole 22 of the seat 14; an internal airway 34 within the cross bar 28, the internal airway 34 in fluid communication with the intake orifice 32 of the cross bar 28; and an output orifice 36 in at least one end of the cross bar 28, the output orifice 36 in the one end of the cross bar 28 in fluid communications with the internal airway 34 of the cross bar 28; a pair of mounting shafts 38, each mounting shaft 38 having: a concave collar 40 on the side of each respective mounting shaft 38, wherein the concave collar 40 of each respective mounting shaft 38 is rotatably attached to a corresponding end of the cross bar 28; and a hollow core 42 in each respective mounting shaft 38, at least one mounting shaft 38 having an intake hole 44 within the concave collar 40 of the mounting shaft 38 having the intake hole 44, the intake hole 44 of the mounting shaft 38 having the intake hole 44 in fluid communications with the hollow core 42 of the mounting shaft 38 having the intake hole 44; the intake hole 44 of the mounting shaft 38 having the intake hole 44 in fluid communications with the corresponding output orifice 36 in the one end of the cross bar 28, a pair of mounting bolts 46, each mounting bolt 46 having a threaded distal end 48, each respective mounting bolt 46 is attached into the hollow core 42 of each corresponding mounting shaft 38, at least one mounting bolt 46 having a hollow cavity 50, the mounting bolt 46 having the hollow cavity 50 having an intake port 52 and an exit port 54, the intake and exit ports (52 and 54) of the mounting bolt 46 having the hollow cavity 50 in fluid communications with the hollow cavity 50 of the mounting bolt 46 having the hollow cavity 50, the intake port 52 of the mounting bolt 46 having the hollow cavity 50 in fluid communications with the intake hole 44 of the mounting shaft 38 having the intake hole 44, a toilet bowl 56 having a mouth 58 and a back 60, the toilet bowl 56 including: a waste water drainage network 62 which is capable of establishing fluid communications with the sewer line 12; a pair of bolt holes 64, each respective bolt hole 64 having a corresponding threaded nut 66 imbedded within the toilet bowl 56 near the distal end of each respective bolt hole 64, each threaded nut 66 of each respective bolt hole 64 is screw fitted to the threaded distal end 48 of each corresponding mounting bolt 46 of the hinge 26, at least one bolt hole 64 having an open input portal 68 at the distal end of the bolt hole 64 having the open input portal 68, the open input portal 68 of the bolt hole 64 having the open input portal 68 in fluid communications with the exit port 54 of the mounting bolt 46 having the hollow cavity 50; a hollow chamber 70 fluidly connected to the open input portal 68 of the at least bolt hole 64 having the open input portal 68, the hollow chamber 70 having: an air intake tube 72 having an input end 76 and an output end 78, the input end 76 of the air intake tube 72 is attached to the open input portal 68 of the bolt hole 64 having the open input portal 68, the air intake tube 72 in fluid communications with the open input portal 68 of the bolt hole 64 having the open input portal 68; an outlet portal 78 of the hollow chamber 70 in fluid communications with the bottom portion of the waste water drainage network 62; an air pump 80 attached to the toilet bowl 56, the air pump 80 having an inlet port 82 and an outlet port 84, the inlet port 82 of the air pump 80 attached to the output end 78 of the air intake tube 72, the air pump 80 in fluid communications with the air intake tube 72; a transformer 86 attached to the air pump 80, the transformer 86 electrically connected to the air pump 80; an electrical cable 88 attached the proximate end of the electrical cable 88 to the transformer 86, the electrical cable 88 is electrically connected to the transformer 86, the distal end of the electrical cable 88 is electrically connectable to a power source; and an air discharge tube 90 having a first end 92 and a second end 94, the first end 92 of the air discharge tube 90 attached to the outlet port 84 of the air pump 80, the air discharge tube 90 in fluid communications with the air pump 80, the second end 94 of the air discharge tube 90 is attached to the outlet portal 78 of the hollow chamber 70, the air discharge tube 90 in fluid communications with the sewer line 12, thereby the a plurality of input vent holes 20 in the seat 14 are in fluid communications with the sewer line 12; and an annular gasket 102.

The wastewater drainage network 62 of the toilet bowl 56 of the kit may comprise a water reservoir 106.

The annular gasket 102 of the kit may be made of beeswax.

An optional electrical plug 96 may be added to the kit. The electrical plug 96 is attachable to the electrical cable 88, in which the electrical plug 96 is electrically connectable to the electrical cable 88, the electrical plug 96 is electrically connectable to a standard electrical wall outlet.

An optional ON/OFF switch 98 may be added to the kit. The ON/OFF switch 98 is attachable to the electrical plug 96, in which the ON/OFF switch 98 is electrically connectable to the electrical plug 96.

An optional seat cover 100 may be added to the kit. The seat cover 100 is attachable to the hinge 26 and pivotally attachable to the toilet bowl 56.

One preferred embodiment of the method of using a kit for installing a ventilated commode device 10 for removing odorous vapors from the immediate vicinity of the device 10, the kit comprises the steps of activating, connecting, defecating, flushing, mounting, obtaining, placing, and plumbing. The obtaining step comprises obtaining the kit comprising: the device 10 comprising: a seat 14 including: a rounded perimeter 16 defining a hollow center, the perimeter 16 for receiving a portion of a user's buttocks; a footer gasket 18 attached around a portion of the bottom of the seat 14; a plurality of input vent holes 20 positioned along the seat 14 between the footer gasket 18 and the inside edge of the perimeter 16; a output vent hole 22 positioned at the rear portion of the seat 14; and an internal air passageway 24 formed within the seat 14, the air passageway 24 is in fluid communications with the plurality of input vent holes 20 and with the output vent hole 22; a hinge 26 connected to the seat 14, the hinge 26 including: a cross bar 28 having: at least one flange 30 connected to the seat 14; an intake orifice 32 in fluid communications with the output vent hole 22 of the seat 14; an internal airway 34 within the cross bar 28, the internal airway 34 in fluid communication with the intake orifice 32 of the cross bar 28; and an output orifice 36 in at least one end of the cross bar 28, the output orifice 36 in the one end of the cross bar 28 in fluid communications with the internal airway 34 of the cross bar 28; a pair of mounting shafts 38, each mounting shaft 38 having: a concave collar 40 on the side of each respective mounting shaft 38, wherein the concave collar 40 of each respective mounting shaft 38 is rotatably attached to a corresponding end of the cross bar 28; and a hollow core 42 in each respective mounting shaft 38, at least one mounting shaft 38 having an intake hole 44 within the concave collar 40 of the mounting shaft 38 having the intake hole 44, the intake hole 44 of the mounting shaft 38 having the intake hole 44 in fluid communications with the hollow core 42 of the mounting shaft 38 having the intake hole 44; the intake hole 44 of the mounting shaft 38 having the intake hole 44 in fluid communications with the corresponding output orifice 36 in the one end of the cross bar 28, a pair of mounting bolts 46, each mounting bolt 46 having a threaded distal end 48, each respective mounting bolt 46 is attached into the hollow core 42 of each corresponding mounting shaft 38, at least one mounting bolt 46 having a hollow cavity 50, the mounting bolt 46 having the hollow cavity 50 having an intake port 52 and an exit port 54, the intake and exit ports (52 and 54) of the mounting bolt 46 having the hollow cavity 50 in fluid communications with the hollow cavity 50 of the mounting bolt 46 having the hollow cavity 50, the intake port 52 of the mounting bolt 46 having the hollow cavity 50 in fluid communications with the intake hole 44 of the mounting shaft 38 having the intake hole 44, a toilet bowl 56 having a mouth 58 and a back 60, the toilet bowl 56 including: a waste water drainage network 62 which is capable of establishing fluid communications with the sewer line 12; a pair of bolt holes 64, each respective bolt hole 64 having a corresponding threaded nut 66 imbedded within the toilet bowl 56 near the distal end of each respective bolt hole 64, each threaded nut 66 of each respective bolt hole 64 is screw fitted to the threaded distal end 48 of each corresponding mounting bolt 46 of the hinge 26, at least one bolt hole 64 having an open input portal 68 at the distal end of the bolt hole 64 having the open input portal 68, the open input portal 68 of the bolt hole 64 having the open input portal 68 in fluid communications with the exit port 54 of the mounting bolt 46 having the hollow cavity 50; a hollow chamber 70 fluidly connected to the open input portal 68 of the at least bolt hole 64 having the open input portal 68, the hollow chamber 70 having: an air intake tube 72 having an input end 76 and an output end 78, the input end 76 of the air intake tube 72 is attached to the open input portal 68 of the bolt hole 64 having the open input portal 68, the air intake tube 72 in fluid communications with the open input portal 68 of the bolt hole 64 having the open input portal 68; an outlet portal 78 of the hollow chamber 70 in fluid communications with the bottom portion of the waste water drainage network 62; an air pump 80 attached to the toilet bowl 56, the air pump 80 having an inlet port 82 and an outlet port 84, the inlet port 82 of the air pump 80 attached to the output end 78 of the air intake tube 72, the air pump 80 in fluid communications with the air intake tube 72; a transformer 86 attached to the air pump 80, the transformer 86 electrically connected to the air pump 80; an electrical cable 88 attached the proximate end of the electrical cable 88 to the transformer 86, the electrical cable 88 is electrically connected to the transformer 86, the distal end of the electrical cable 88 is electrically connectable to a power source; an air discharge tube 90 having a first end 92 and a second end 94, the first end 92 of the air discharge tube 90 attached to the outlet port 84 of the air pump 80, the air discharge tube 90 in fluid communications with the air pump 80, the second end 94 of the air discharge tube 90 is attached to the outlet portal 78 of the hollow chamber 70, the air discharge tube 90 in fluid communications with the sewer line 12, thereby the plurality of input vent holes 20 in the seat 14 are in fluid communications with the sewer line 12; and an annular gasket 102. The placing step comprises placing the annular gasket 102 around the sewer line 12, the placing step performed subsequent to the obtaining step. The mounting step comprises mounting the device 10 onto the sewer line 12, the mounting step performed subsequent to the placing step. The connecting step comprises connecting the distal end of the electrical cable 88 an electrical power outlet, wherein the electrical cable 88 is operatively connected to the electrical power outlet, the connecting step performed subsequent to the obtaining step. The plumbing step comprises plumbing a water line to the waste water drainage network 62 of the toilet bowl 56 so that the mouth 58 of the toilet bowl 56 contains water, the plumbing step performed subsequent to the mounting step. The defecating step comprises defecating into the mouth 58 of the toilet bowl 56 to create the odorous vapor near the immediate vicinity of the device 10, the defecating step performed subsequent to the mounting, connecting, and plumbing steps. The activating step comprises activating the pump of the device 10 to remove a portion of the odorous vapor from the immediate vicinity of the device 10, the activating step performed subsequent to the defecating step. The flushing step comprises flushing the water in the bowl of the toilet bowl 56, the flushing step performed subsequent to the defecating step.

Referring now to FIG. 1 which depicts a side view of a preferred embodiment of the ventilated commode device 10 showing a seat 14 including: a rounded perimeter 16 defining a hollow center, the perimeter 16 for receiving a portion of a user's buttocks; a footer gasket 18 attached around a portion of the bottom of the seat 14; a hinge 26 connected to the seat 14, the hinge 26 having a mounting shaft 38; a mounting bolt 46 attached through the mounting shaft 38; a toilet bowl 56 having a mouth 58 and a back 60, the toilet bowl 56 including: an air pump 80 attached to the toilet bowl 56; a transformer 86 attached to the air pump 80, the transformer 86 electrically connected to the air pump 80; an electrical cable 88 attached the proximate end of the electrical cable 88 to the transformer 86, the electrical cable 88 is electrically connected to the transformer 86, the distal end of the electrical cable 88 is electrically connected to an ON/OFF switch 98 and an electrical plug electrically connected to the ON/OFF switch 98.

Figure 2:
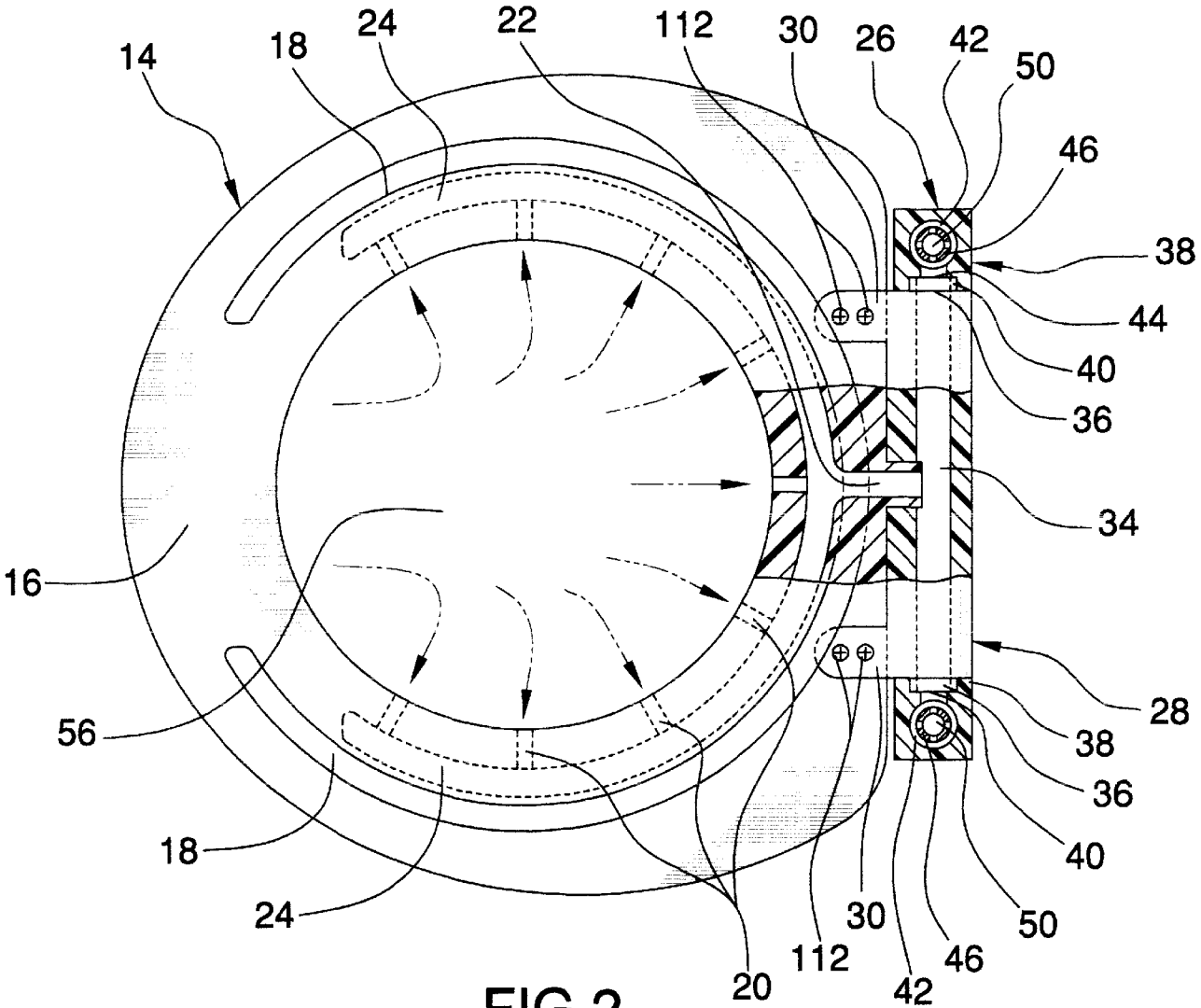
FIG. 2 is a partial cross sectional top view of a preferred embodiment of the ventilated commode device of the present invention.

Referring now to FIG. 2 which depicts a partial cross sectional top view of a preferred embodiment of the ventilated commode device 10 showing a seat 14 including: a rounded perimeter 16 defining a hollow center, the perimeter 16 for receiving a portion of a user's buttocks; a footer gasket 18 attached around a portion of the bottom of the seat 14; a plurality of input vent holes 20 positioned along the seat 14 between the footer gasket 18 and the inside edge of the perimeter 16; a output vent hole 22 positioned at the rear portion of the seat 14; and an internal air passageway 24 formed within the seat 14, the air passageway 24 is in fluid communications with the plurality of input vent holes 20 and with the output vent hole 22; a hinge 26 connected to the seat 14, the hinge 26 including: a cross bar 28 having: at least one flange 30 connected to the seat 14; an intake orifice 32 in fluid communications with the output vent hole 22 of the seat 14; an internal airway 34 within the cross bar 28, the internal airway 34 in fluid communication with the intake orifice 32 of the cross bar 28; and an output orifice 36 in at least one end of the cross bar 28, the output orifice 36 in the one end of the cross bar 28 in fluid communications with the internal airway 34 of the cross bar 28; a pair of mounting shafts 38, each mounting shaft 38 having: a concave collar 40 on the side of each respective mounting shaft 38, wherein the concave collar 40 of each respective mounting shaft 38 is rotatably attached to a corresponding end of the cross bar 28; and a hollow core 42 in each respective mounting shaft 38, at least one mounting shaft 38 having an intake hole 44 within the concave collar 40 of the mounting shaft 38 having the intake hole 44, the intake hole 44 of the mounting shaft 38 having the intake hole 44 in fluid communications with the hollow core 42 of the mounting shaft 38 having the intake hole 44; the intake hole 44 of the mounting shaft 38 having the intake hole 44 in fluid communications with the corresponding output orifice 36 in the one end of the cross bar 28; a pair of mounting bolts 46, each mounting bolt 46 having a threaded distal end 48, each respective mounting bolt 46 is attached into the hollow core 42 of each corresponding mounting shaft 38, at least one mounting bolt 46 having a hollow cavity 50, the mounting bolt 46 having the hollow cavity 50 having an intake port 52 and an exit port 54, the intake and exit ports (52 and 54) of the mounting bolt 46 having the hollow cavity 50 in fluid communications with the hollow cavity 50 of the mounting bolt 46 having the hollow cavity 50, the intake port 52 of the mounting bolt 46 having the hollow cavity 50 in fluid communications with the intake hole 44 of the mounting shaft 38 having the intake hole 44; and showing a toilet bowl 56 having a mouth 58.

Figure 3:
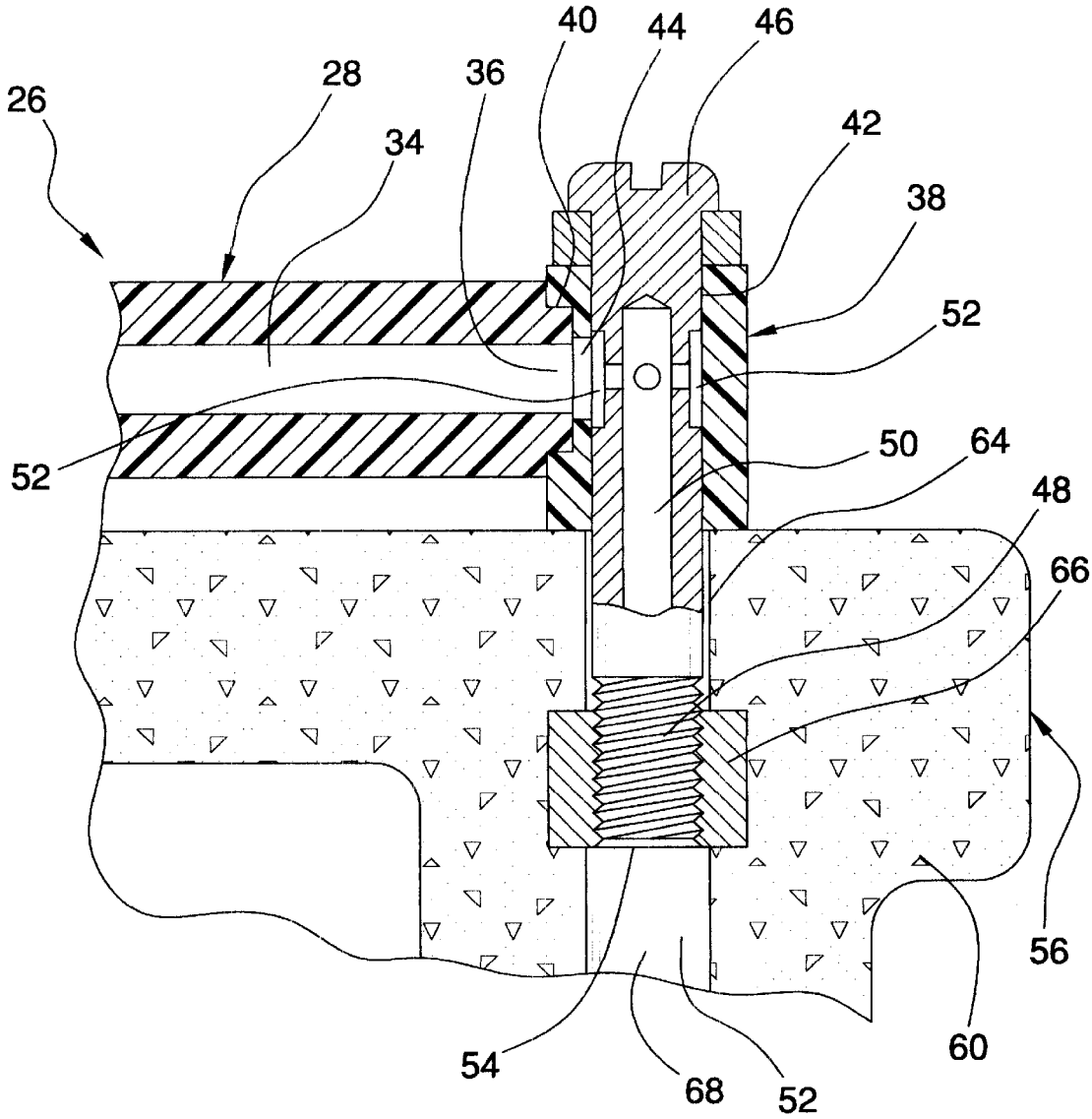
FIG. 3 is a cross sectional side view of a rear portion of the preferred embodiment of the ventilated commode device of the present invention.

Referring now to FIG. 3 which depicts a cross sectional side view of a rear portion of the preferred embodiment of the ventilated commode device 10 showing a hinge 26 including: a cross bar 28 having an internal airway 34 within the cross bar 28, the internal airway 34 in fluid communication with the intake orifice 32 of the cross bar 28; and an output orifice 36 in at least one end of the cross bar 28, the output orifice 36 in the one end of the cross bar 28 in fluid communications with the internal airway 34 of the cross bar 28; a pair of mounting shafts 38, each mounting shaft 38 having: a concave collar 40 on the side of each respective mounting shaft 38, wherein the concave collar 40 of each respective mounting shaft 38 is rotatably attached to a corresponding end of the cross bar 28; and a hollow core 42 in each respective mounting shaft 38, at least one mounting shaft 38 having an intake hole 44 within the concave collar 40 of the mounting shaft 38 having the intake hole 44, the intake hole 44 of the mounting shaft 38 having the intake hole 44 in fluid communications with the hollow core 42 of the mounting shaft 38 having the intake hole 44; the intake hole 44 of the mounting shaft 38 having the intake hole 44 in fluid communications with the corresponding output orifice 36 in the one end of the cross bar 28; a pair of mounting bolts 46, each mounting bolt 46 having a threaded distal end 48, each respective mounting bolt 46 is attached into the hollow core 42 of each corresponding mounting shaft 38, at least one mounting bolt 46 having a hollow cavity 50, the mounting bolt 46 having the hollow cavity 50 having an intake port 52 and an exit port 54, the intake and exit ports (52 and 54) of the mounting bolt 46 having the hollow cavity 50 in fluid communications with the hollow cavity 50 of the mounting bolt 46 having the hollow cavity 50, the intake port 52 of the mounting bolt 46 having the hollow cavity 50 in fluid communications with the intake hole 44 of the mounting shaft 38 having the intake hole 44; and a toilet bowl 56 having a mouth 58 and a back 60, the toilet bowl 56 including: a bolt hole 64 having a corresponding threaded nut 66 imbedded within the toilet bowl 56 near the distal end of each respective bolt hole 64, each threaded nut 66 of each respective bolt hole 64 is screw fitted to the threaded distal end 48 of each corresponding mounting bolt 46 of the hinge 26, at least one bolt hole 64 having an open input portal 68 at the distal end of the bolt hole 64 having the open input portal 68, the open input portal 68 of the bolt hole 64 having the open input portal 68 in fluid communications with the exit port 54 of the mounting bolt 46 having the hollow cavity 50.

Figure 4:
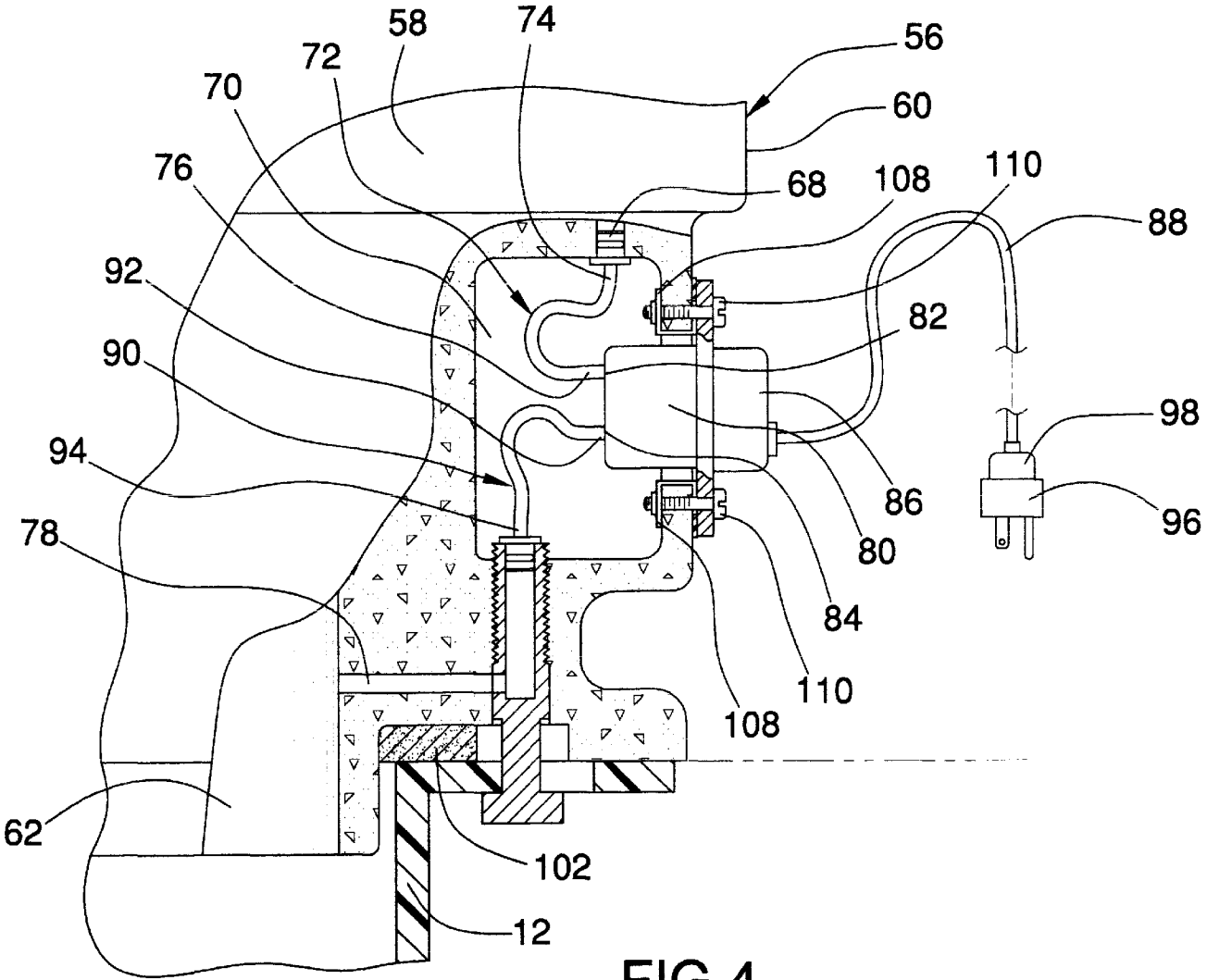
FIG. 4 is a partial cross sectional cutaway side view of a preferred embodiment of the ventilated commode device of the present invention.

Referring now to FIG. 4 which depicts a partial cross sectional cutaway side view of a preferred embodiment of the ventilated commode device 10 showing a toilet bowl 56 having a mouth 58 and a back 60, the toilet bowl 56 including: a waste water drainage network 62 in fluid communications with the sewer line 12; an open input portal 68 at the distal end of the bolt hole 64 having the open input portal 68, the open input portal 68 of the bolt hole 64 having the open input portal 68 in fluid communications with the exit port 54 of the mounting bolt 46 having the hollow cavity 50; a hollow chamber 70 fluidly connected to the open input portal 68 of the at least bolt hole 64 having the open input portal 68, the hollow chamber 70 having: an air intake tube 72 having an input end 76 and an output end 78, the input end 76 of the air intake tube 72 is attached to the open input portal 68 of the bolt hole 64 having the open input portal 68, the air intake tube 72 in fluid communications with the open input portal 68 of the bolt hole 64 having the open input portal 68; an outlet portal 78 of the hollow chamber 70 in fluid communications with the bottom portion of the waste water drainage network 62; an air pump 80 attached to the toilet bowl 56, the air pump 80 having an inlet port 82 and an outlet port 84, the inlet port 82 of the air pump 80 attached to the output end 78 of the air intake tube 72, the air pump 80 in fluid communications with the air intake tube 72; a transformer 86 attached to the air pump 80, the transformer 86 electrically connected to the air pump 80; an electrical cable 88 attached the proximate end of the electrical cable 88 to the transformer 86, the electrical cable 88 is electrically connected to the transformer 86, the distal end of the electrical cable 88 is electrically connected to an ON/OFF switch 98 and the ON/OFF switch 98 operatively connected to an electrical plug which is able to be operatively connected to a power source; and an air discharge tube 90 having a first end 92 and a second end 94, the first end 92 of the air discharge tube 90 attached to the outlet port 84 of the air pump 80, the air discharge tube 90 in fluid communications with the air pump 80, the second end 94 of the air discharge tube 90 is attached to the outlet portal 78 of the hollow chamber 70, the air discharge tube 90 in fluid communications with the sewer line 12, thereby the a plurality of input vent holes 20 in the seat 14 are in fluid communications with the sewer line 12.

As to the manner of usage and operation of the present invention, the same should be apparent from the above description. Accordingly, no further discussion relating to the manner of usage and operation will be provided.

While a preferred embodiment of the ventilated commode device has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

With respect to the above description then, it is to be realized that the optimum dimensional relationships for the parts of the invention, to include variations in size materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A ventilated commode device for removing odorous vapors from the immediate vicinity of said device into a sewer line, said device comprising:

a seat including:

a rounded perimeter defining a hollow center, said perimeter for receiving a portion of a user's buttocks;

a footer gasket attached around a portion of the bottom of said seat;

a plurality of input vent holes positioned along said seat between said footer gasket and the inside edge of said perimeter;

an output vent hole positioned at the rear portion of said seat; and an internal air passageway formed within said seat, said air passageway is in fluid communications with said plurality of input vent holes and with said output vent hole;

a hinge connected to said seat, said hinge including:

a cross bar having:

at least one flange connected to said seat;

an intake orifice in fluid communications with said output vent hole of said seat;

an internal airway within said cross bar, said internal airway in fluid communication with said intake orifice of said cross bar; and an output orifice in at least one end of said cross bar, said output orifice in said one end of said cross bar in fluid communications with said internal airway of said cross bar;

a pair of mounting shafts, each mounting shaft having:

a concave collar on the side of each respective mounting shaft, wherein said concave collar of each respective mounting shaft is rotatably attached to a corresponding end of said cross bar; and a hollow core in each respective mounting shaft, at least one mounting shaft having an intake hole within said concave collar of said mounting shaft having said intake hole, said intake hole of said mounting shaft having said intake hole in fluid communications with said hollow core of said mounting shaft having said intake hole;

said intake hole of said mounting shaft having said intake hole in fluid communications with said corresponding output orifice in said one end of said cross bar;

a pair of mounting bolts, each mounting bolt having a threaded distal end, each respective mounting bolt is attached into said hollow core of each corresponding mounting shaft, at least one mounting bolt having a hollow cavity, said mounting bolt having said hollow cavity having an intake port and an exit port, said intake and exit ports of said mounting bolt having said hollow cavity in fluid communications with said hollow cavity of said mounting bolt having said hollow cavity, said intake port of said mounting bolt having said hollow cavity in fluid communications with said intake hole of said mounting shaft having said intake hole;

a toilet bowl having a mouth and a back, said toilet bowl including:

a waste water drainage network in fluid communications with the sewer line;

a pair of bolt holes, each respective bolt hole having a corresponding threaded nut imbedded within said toilet bowl near the distal end of each respective bolt hole, each threaded nut of each respective bolt hole is screw fitted to the threaded distal end of each corresponding mounting bolt of said hinge, at least one bolt hole having an open input portal at the distal end of said bolt hole having said open input portal, said open input portal of said bolt hole having said open input portal in fluid communications with said exit port of said mounting bolt having said hollow cavity;

a hollow chamber fluidly connected to said open input portal of said at least bolt hole having said open input portal, said hollow chamber having:

an air intake tube having an input end and an output end, said input end of said air intake tube is attached to said open input portal of said bolt hole having said open input portal, said air intake tube in fluid communications with said open input portal of said bolt hole having said open input portal;

an outlet portal which is in fluid communications with the bottom portion of said waste water drainage network;

an air pump attached to said toilet bowl, said air pump having an inlet port and an outlet port, said inlet port of said air pump attached to said output end of said air intake tube, said air pump in fluid communications with said air intake tube;

a transformer attached to said air pump, said transformer electrically connected to said air pump;

an electrical cable attached the proximate end of said electrical cable to said transformer, said electrical cable is electrically connected to said transformer, the distal end of said electrical cable is electrically connectable to a power source; and an air discharge tube having a first end and a second end, said first end of said air discharge tube attached to said outlet port of said air pump, said air discharge tube in fluid communications with said air pump, said second end of said air discharge tube is attached to said outlet portal of said hollow chamber, said air discharge tube in fluid communications with the bottom portion of said waste water drainage network, thereby said a plurality of input vent holes in said seat are in fluid communications with said sewer line.

2. The device described in claim 1 further comprising an electrical plug attached to said electrical cable, said electrical plug is electrically connected to said electrical cable, said electrical plug is electrically connectable to a standard electrical wall outlet.

3. The device described in claim 2 further comprising an ON/OFF switch attached to said electrical plug, said ON/OFF switch is electrically connected to said electrical plug.

4. The device described in claim 1 further comprising a seat cover pivotally attach to said hinge and pivotally attached to said toilet bowl.

5. The device described in claim 1 wherein said waste water drainage network of said toilet bowl having a water reservoir.

6. The device described in claim 1 further comprising an annular gasket connected between said waste water drainage network of said toilet bowl and the sewer line.

7. The device described in claim 6 wherein said annular gasket is made of beeswax.

8. The device described in claim 1 wherein said waste water drainage network of said toilet bowl having a flush switch.

9. The device described in claim 1 wherein when said seat is pivoted downwards onto said mouth of said toilet bowl so that said footer gasket contacts the mouth of said toilet bowl, then said seat is in a sitting position.

10. The device described in claim 1 wherein when said seat is pivoted upwards toward the back of said toilet bowl so that said footer gasket does not contact the mouth of said toilet bowl, then said seat is in an upright position.

11. The device described in claim 1 wherein said air pump further comprising a pair of brackets attached to said toilet bowl along the edge of said hollow chamber of said toilet bowl.

12. The device described in claim 11 wherein said air pump further comprising a pair of mounting pegs attaching said brackets of said air pump to said toilet bowl.

13. The device described in claim 1 wherein said hinge further comprises a plurality of screws attaching said flange of said hinge to said seat.

14. A kit for a ventilated commode device for removing odorous vapors from the immediate vicinity of said device into a sewer line, said kit comprising:

said device comprising:

a seat including:

a rounded perimeter defining a hollow center, said perimeter for receiving a portion of a user's buttocks;

a footer gasket attached around a portion of the bottom of said seat;

a plurality of input vent holes positioned along said seat between said footer gasket and the inside edge of said perimeter;

an output vent hole positioned at the rear portion of said seat; and an internal air passageway formed within said seat, said air passageway is in fluid communications with said plurality of input vent holes and with said output vent hole;

a hinge connected to said seat, said hinge including:
a cross bar having:
at least one flange connected to said seat;
an intake orifice in fluid communications with said output vent hole of said seat;
an internal airway within said cross bar, said internal airway in fluid communication with said intake orifice of said cross bar; and
an output orifice in at least one end of said cross bar, said output orifice in said one end of said cross bar in fluid communications with said internal airway of said cross bar;
a pair of mounting shafts, each mounting shaft having:
a concave collar on the side of each respective mounting shaft, wherein said concave collar of each respective mounting shaft is rotatably attached to a corresponding end of said cross bar; and
a hollow core in each respective mounting shaft,
at least one mounting shaft having an intake hole within said concave collar of said mounting shaft having said intake hole,
said intake hole of said mounting shaft having said intake hole in fluid communications with said hollow core of said mounting shaft having said intake hole;
said intake hole of said mounting shaft having said intake hole in fluid communications with said corresponding output orifice in said one end of said cross bar,
a pair of mounting bolts, each mounting bolt having a threaded distal end, each respective mounting bolt is attached into said hollow core of each corresponding mounting shaft,
at least one mounting bolt having a hollow cavity,
said mounting bolt having said hollow cavity having an intake port and an exit port, said intake and exit ports of said mounting bolt having said hollow cavity in fluid communications with said hollow cavity of said mounting bolt having said hollow cavity,
said intake port of said mounting bolt having said hollow cavity in fluid communications with said intake hole of said mounting shaft having said intake hole;
a toilet bowl having a mouth and a back, said toilet bowl including:
a waste water drainage network which is capable of establishing fluid communications with the sewer line;
a pair of bolt holes, each respective bolt hole having a corresponding threaded nut imbedded within said toilet bowl near the distal end of each
respective bolt hole, each threaded nut of each respective bolt hole is screw fitted to the threaded distal end of each corresponding mounting bolt of said hinge,
at least one bolt hole having an open input portal at the distal end of said bolt hole having said open input portal, said open input portal of said bolt hole having said open input portal in fluid communications with said exit port of said mounting bolt having said hollow cavity;
a hollow chamber fluidly connected to said open input portal of said at least bolt hole having said open input portal, said hollow chamber having:
an air intake tube having an input end and an output end, said input end of said air intake tube is attached to said open input portal of said bolt hole having said open input portal, said air intake tube in fluid communications with said open input portal of said bolt hole having said open input portal;
an outlet portal of said hollow chamber in fluid communications with the bottom portion of said waste water drainage network;
an air pump attached to said toilet bowl, said air pump having an inlet port and an outlet port, said inlet port of said air pump attached to said output end of said air intake tube, said air pump in fluid communications with said air intake tube;
a transformer attached to said air pump, said transformer electrically connected to said air pump;
an electrical cable attached the proximate end of said electrical
cable to said transformer, said electrical cable is electrically connected to said transformer, the distal end of said electrical cable is electrically connectable to a power source;
an air discharge tube having a first end and a second end, said first end of said air discharge tube attached to said outlet port of said air pump, said air discharge tube in fluid communications with said air pump, said second end of said air discharge tube is attached to said outlet portal of said hollow chamber, said air discharge tube in fluid communications with the bottom portion of said waste water drainage network,
thereby said a plurality of input vent holes in said seat are in fluid communications with the bottom portion of said waste water drainage network; and
an annular gasket.

15. The kit described in claim 14 further comprising an electrical plug attachable to said electrical cable, said electrical plug is electrically connectable to said electrical cable, said electrical plug is electrically connectable to a standard electrical wall outlet.

16. The kit described in claim 15 further comprising an ON/OFF switch attachable to said electrical plug, said ON/OFF switch is electrically connectable to said electrical plug.

17. The kit described in claim 15 wherein said waste water drainage network of said toilet bowl having a water reservoir.

18. The kit described in claim 14 further comprising a seat cover attachable to said hinge and pivotally attachable to said toilet bowl.

19. The kit described in claim 14 said annular gasket is made of beeswax.

20. A method of using a kit for installing a ventilated commode device for removing odorous vapors from the immediate vicinity of the device, the kit comprising:

obtaining the kit comprising:
the device comprising:
a seat including:
a rounded perimeter defining a hollow center, the perimeter for receiving a portion of a user's buttocks;
a footer gasket attached around a portion of the bottom of the seat;
a plurality of input vent holes positioned along the seat between the footer gasket and the inside edge of the perimeter;
an output vent hole positioned at the rear portion of the seat; and
an internal air passageway formed within the seat, the air passageway is in fluid communications with the plurality of input vent holes and with the output vent hole;

a hinge connected to the seat, the hinge including:

a cross bar having:

at least one flange connected to the seat;

an intake orifice in fluid communications with the output vent hole of the seat;

an internal airway within the cross bar, the internal airway in fluid communication with the intake orifice of the cross bar; and an output orifice in at least one end of the cross bar, the output orifice in the one end of the cross bar in fluid communications with the internal airway of the cross bar;

a pair of mounting shafts, each mounting shaft having:

a concave collar on the side of each respective mounting shaft, wherein the concave collar of each respective mounting shaft is rotatably attached to a corresponding end of the cross bar; and a hollow core in each respective mounting shaft, at least one mounting shaft having an intake hole within the concave collar of the mounting shaft having the intake hole, the intake hole of the mounting shaft having the intake hole in fluid communications with the hollow core of the mounting shaft having the intake hole;

the intake hole of the mounting shaft having the intake hole in fluid communications with the corresponding output orifice in the one end of the cross bar, a pair of mounting bolts, each mounting bolt having a threaded distal end, each respective mounting bolt is attached into the hollow core of each corresponding mounting shaft, at least one mounting bolt having a hollow cavity, the mounting bolt having the hollow cavity having an intake port and an exit port, the intake and exit ports of the mounting bolt having the hollow cavity in fluid communications with the hollow cavity of the mounting bolt having the hollow cavity, the intake port of the mounting bolt having the hollow cavity in fluid communications with the intake hole of the mounting shaft having the intake hole;

a toilet bowl having a mouth and a back, the toilet bowl including:

a waste water drainage network which is capable of establishing fluid communications with the sewer line;

a pair of bolt holes, each respective bolt hole having a corresponding threaded nut imbedded within the toilet bowl near the distal end of each respective bolt hole, each threaded nut of each respective bolt hole is screw fitted to the threaded distal end of each corresponding mounting bolt of the hinge, at least one bolt hole having an open input portal at the distal end of the bolt hole having the open input portal, the open input portal of the bolt hole having the open input portal in fluid communications with the exit port of the mounting bolt having the hollow cavity;

a hollow chamber fluidly connected to the open input portal of the at least bolt hole having the open input portal, the hollow chamber having:

an air intake tube having an input end and an output end, the input end of the air intake tube is attached to the open input portal of the bolt hole having the open input portal, the air intake tube in fluid communications with the open input portal of the bolt hole having the open input portal;

an outlet portal of the hollow chamber which is in fluid communications with the bottom portion of said waste water drainage network;

an air pump attached to the toilet bowl, the air pump having an inlet port and an outlet port, the inlet port of the air pump attached to the output end of the air intake tube, the air pump in fluid communications with the air intake tube;

a transformer attached to the air pump, the transformer electrically connected to the air pump;

an electrical cable attached the proximate end of the electrical cable to the transformer, the electrical cable is electrically connected to the transformer, the distal end of the electrical cable is electrically connectable to a power source; and an air discharge tube having a first end and a second end, the first end of the air discharge tube attached to the outlet port of the air pump, the air discharge tube in fluid communications with the air pump, the second end of the air discharge tube is attached to the outlet portal of the hollow chamber, the air discharge tube in fluid communications with the bottom portion of said waste water drainage network, thereby the a plurality of input vent holes in the seat are in fluid communications with the bottom portion of said waste water drainage network; and an annular gasket;

placing the annular gasket around the sewer line, said placing step performed subsequent to said obtaining step;

mounting the device onto the sewer line, said mounting step performed subsequent to said placing step; connecting the distal end of the electrical cable an electrical power outlet, wherein said electrical cable is operatively connected to said electrical power outlet, said connecting step performed subsequent to said obtaining step;

plumbing a water line to the waste water drainage network of the toilet bowl so that the mouth of the toilet bowl contains water, said plumbing step performed subsequent to said mounting step;

defecating into the mouth of said toilet bowl to create the odorous vapor near the immediate vicinity of the device, said defecating step performed subsequent to said mounting, connecting, and plumbing steps;

activating the pump of the device to remove a portion of the odorous vapor from the immediate vicinity of the device, said activating step performed subsequent to said defecating step; and flushing the water in the bowl of the toilet bowl, said flushing step performed subsequent to said defecating step.

* * * * *